US006574936B1

(12) United States Patent
Anderson, Sr.

(10) Patent No.: US 6,574,936 B1
(45) Date of Patent: Jun. 10, 2003

(54) FABRIC WALL PANEL SYSTEM

(75) Inventor: Andy W. Anderson, Sr., Douglasville, GA (US)

(73) Assignee: Accutrack Systems, Inc., Austell, GA (US)

( * ) Notice: Subject to any disclaimer, the term of this patent is extended or adjusted under 35 U.S.C. 154(b) by 20 days.

(21) Appl. No.: 09/853,826

(22) Filed: May 11, 2001

(51) Int. Cl.[7] ..... E04H 5/00

(52) U.S. Cl. ..... 52/506.06; 52/63; 52/222; 52/273; 52/100

(58) Field of Search ..... 52/506.06, 100, 52/63, 222, 273; 403/204

(56) References Cited

U.S. PATENT DOCUMENTS

| | | | | |
|---|---|---|---|---|
| 1,201,338 A | * | 10/1916 | Orr | |
| 2,112,631 A | | 3/1938 | MacDonald | |
| 2,526,912 A | * | 10/1950 | Swanson | 160/181 |
| 3,380,210 A | * | 4/1968 | Neal et al. | 52/235 |
| 3,706,171 A | | 12/1972 | Shayman | |
| 3,757,479 A | * | 9/1973 | Martinez | 160/392 |
| 3,871,153 A | * | 3/1975 | Birum, Jr. | 52/239 |
| 3,948,347 A | | 4/1976 | Rutledge | |
| 3,963,094 A | | 6/1976 | Nowikas | |
| 3,971,867 A | | 7/1976 | Randall | |
| 4,146,999 A | | 4/1979 | Petrovec et al. | |
| 4,197,923 A | | 4/1980 | Harris et al. | |
| 4,250,676 A | * | 2/1981 | Presby | 160/135 |
| 4,283,891 A | | 8/1981 | Moeller | |
| 4,479,339 A | | 10/1984 | Kroh | |
| 4,949,518 A | * | 8/1990 | Nagel et al. | 52/239 |
| 5,009,043 A | | 4/1991 | Kurrasch | |
| 5,174,086 A | | 12/1992 | Payne et al. | |
| 5,715,638 A | | 2/1998 | Anderson | |
| 5,769,562 A | * | 6/1998 | Jones | 404/7 |
| 5,806,257 A | * | 9/1998 | Cornils et al. | 295/146.15 |

* cited by examiner

*Primary Examiner*—Carl D. Friedman
*Assistant Examiner*—Basil Katcheves
(74) *Attorney, Agent, or Firm*—Smith, Gambrell & Russell, LLP

(57) ABSTRACT

A fabric wall panel system includes wall panels mounted on a wall by means of a releasable hanger. Each fabric wall panel comprises a frame and a flat filler insert covered by a fabric. Each frame member has a flat spine, an outside web, an inside web, and a front web. Together the outside web, the inside web, and the front web form a hollow channel along the edge of the frame member with internal protrusions to engage the hanger and hold the fabric wall panel in place on the wall. The hanger comprises a resilient material with a flat base affixed to the wall with two forked tongues extend perpendicularly therefrom. The forked tongues engage the protrusions within the hollow channel to hold the frame member securely to the hanger and thus to the wall. The hanger with its resilient forked tongues assures proper spacing between the adjacent fabric wall panels mounted on the hanger.

19 Claims, 3 Drawing Sheets

Fig. 1
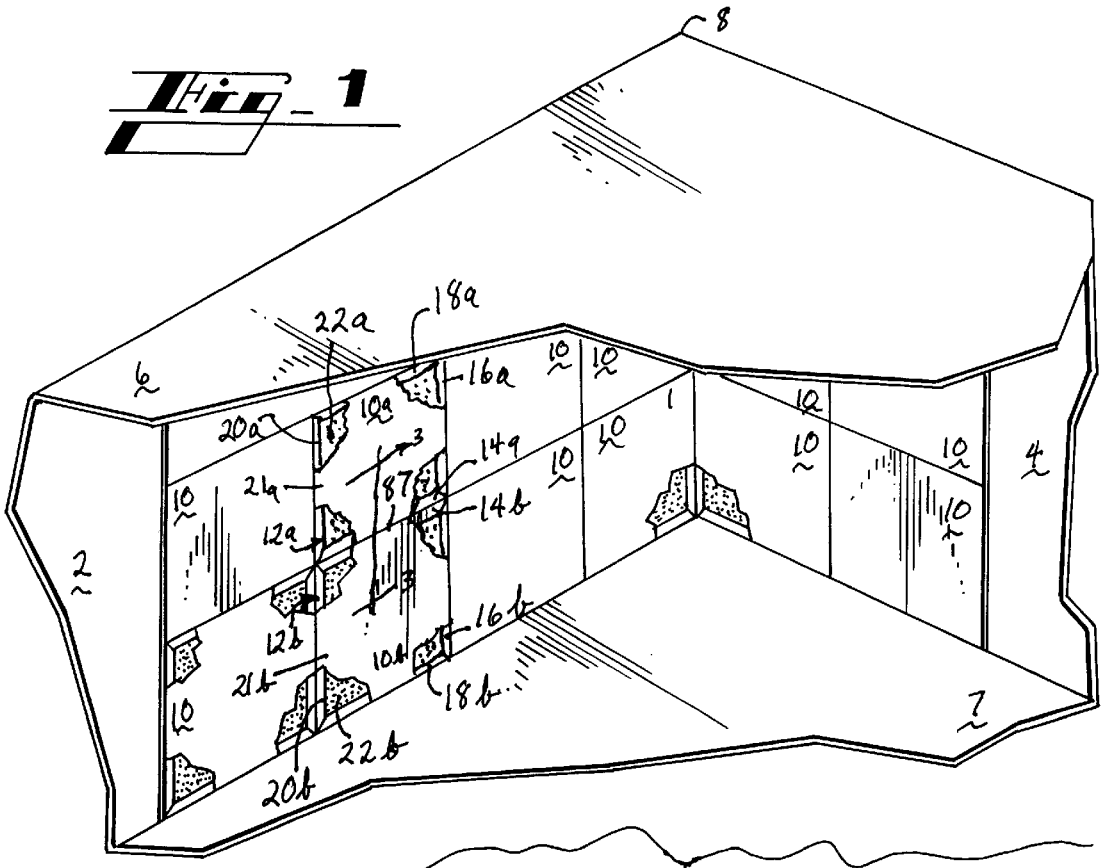
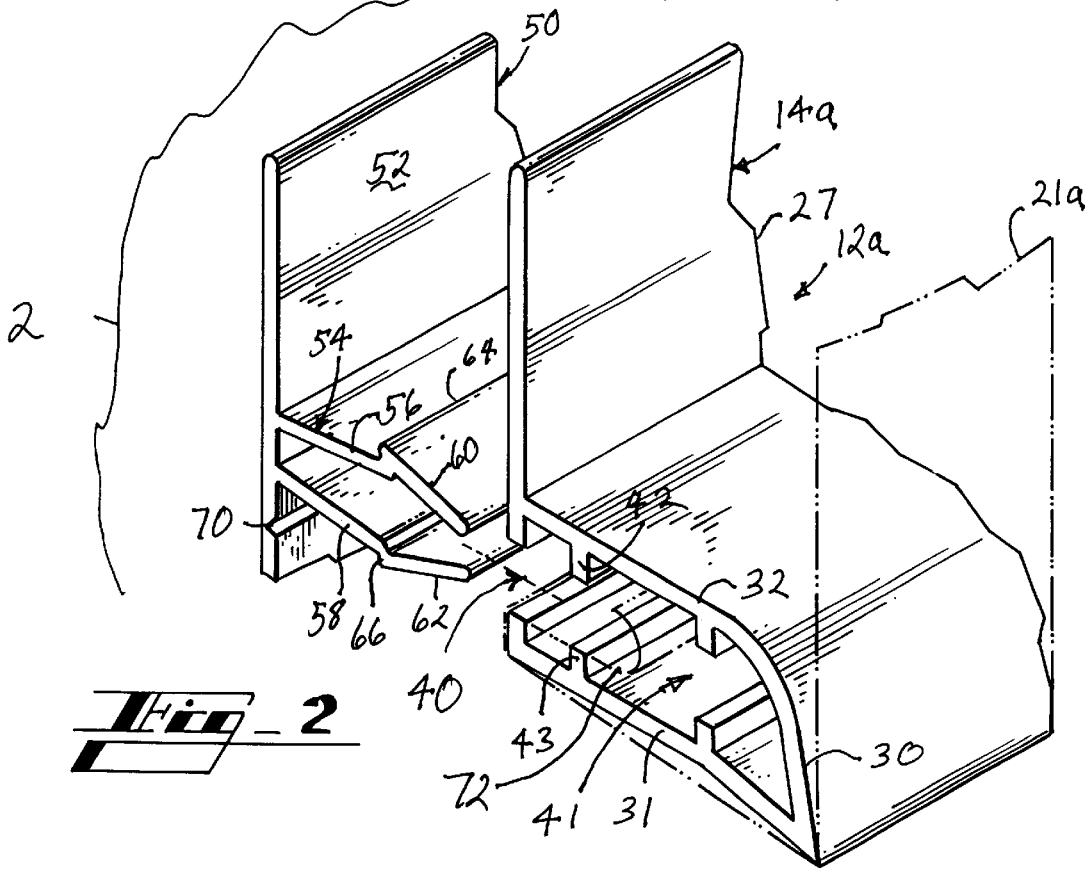
Fig. 2

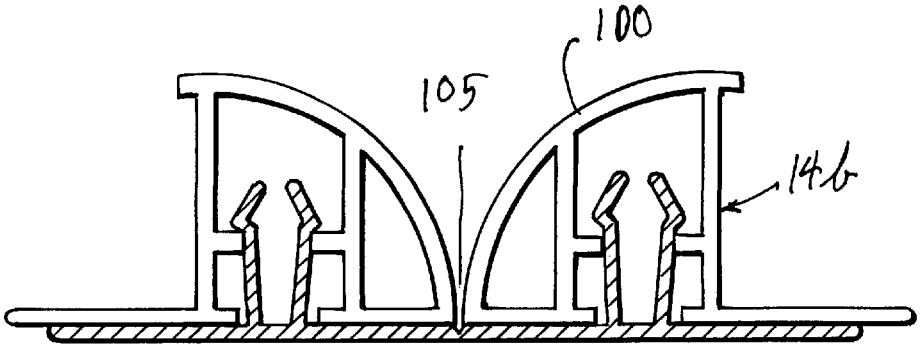
Fig. 5
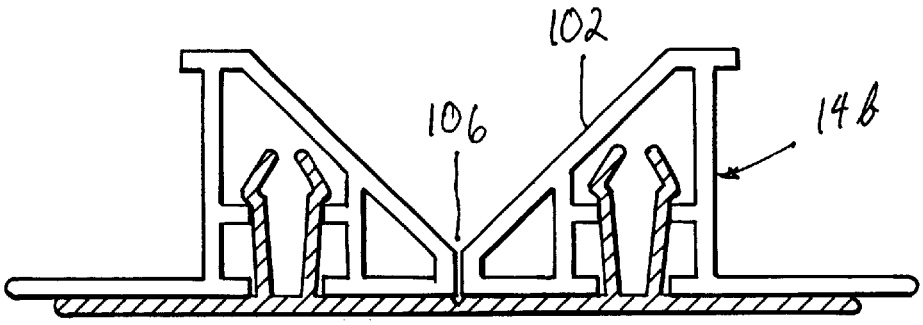
Fig. 6
Fig. 7
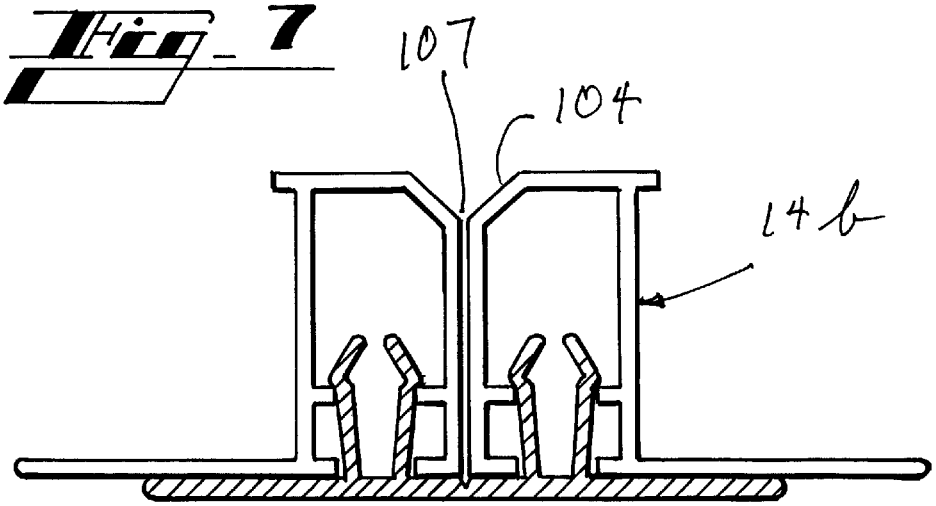

FABRIC WALL PANEL SYSTEM

FIELD OF THE INVENTION

This invention relates to a fabric wall panel system for use in decorating, and more particularly, relates to a fabric wall panel system having fabric wall panels which are removably mounted to a wall so that the seams between the fabric wall panels are uniform and fit tightly.

BACKGROUND OF THE INVENTION

Fabric wall panels are used to decorate the interior space in many buildings. Fabric coverings for the panels are available in numerous textures and patterns which can be coordinated with the furnishings and carpets in a room. These fabric wall panels can be customized to meet the decorating needs of various locations and decorating tastes.

Besides decorating versatility, fabric wall panels provide other desirable features. Such features include sound and heat insulation. Particularly, in large rooms such as auditoriums and theaters, fabric wall panels may include a layer of acoustical material hidden behind the fabrics which modifies the acoustical character of the room. In addition, heat insulating material may be mounted behind the fabrics to enhance heat transfer properties of a wall.

A substantial costs involved in fabric panels is the cost of installation. Moreover, if the fabric becomes worn or the decorating scheme changes, the need may arise to change the fabric panels. Consequently, the method of mounting and/or changing the fabric wall panels becomes an important consideration when fabric wall panels are selected for a building project.

Another consideration in the selection and use of fabric wall panels is assuring a quality installation. Particularly, the wall panels should line up uniformly with each other, and the seams between adjacent wall panels should be tight and uniform. With most fabric wall panel systems, quality of installation including alignment and uniformity of seams depends on the skill of the installer.

Some prior fabric wall panels are installed in situ. For example, as disclosed in Baslow U.S. Pat. No. 4,018,260, border pieces of a panel are permanently attached to the wall to form a framework for mounting a fabric sheet. The fabric sheet completely covers the wall without being adhered to the wall itself. The linear border pieces include a key way into which the fabric is forced by means of a compressible spline. The linear border pieces also include a storage channel, which allows the border pieces to create a finished look at the edges. The Baslow patent does not disclose a method of fabric wall panel prefabrication or removable attachment. The uniformity of installation depends on the skill of the installer in terms of aligning the framework and forcing the fabric into the key way so that the fabric is uniformly stretched on the framework.

In addition, fabric wall panels can be prefabricated. One method for installing prefabricated fabric wall panels employs a cross-nailing system as disclosed by the patent to Anderson, U.S. Pat. No. 4,731,972. The fabric wall panels disclosed in the Anderson patent are prefabricated and then installed by driving two headless pin nails at an angle in a crossed fashion through the frame pieces of the prefabricated panels. The crossed nails penetrate completely through the fabric, partially penetrate the frame, and securely fasten the panel to the wall. A fabric wall panel attached using this cross-nailing method cannot be easily removed from the wall if one should desire to replace panels or remove the panels entirely.

One successful removable wall panel system is disclosed in Anderson U.S. Pat. No. 5,715,638. In that patent, the fabric wall panels are mounted on the wall by means of hangers. Each frame member of each wall panel has a spine with an elongated slit, a side edge, and a front edge which together define a groove. A flat filler insert is fitted within the groove of each frame member. Fabric is stretched over the frame and flat filler insert and is bonded to the back of the spine of each frame member to complete the finished fabric wall panel. The hanger has a flat base and a perpendicularly extending tongue with an enlarged head. A number of hangers are affixed on the wall using an adhesive. The slit on the frame of the fabric wall panel is aligned with the tongue of hanger on the wall, and the fabric wall panel is affixed to the wall by pressing the slit over the tongue on the hanger. The fabric wall panels can be prefabricated or installed in situ. The fabric wall panels can also be independently replaced or removed entirely by unsnapping the fabric wall panel from the supporting hangers.

While the disclosed fabric wall panel system has been successful, several improvements are needed. First, because the spacing between panels depends on the thickness of the fabric replacing a thick fabric with a thinner fabric can result in open mid-wall seams between panels. Second, the underlying frame of the fabric panels sometimes show through under the stretched fabric. Third, gluing the fabric to the frame can make removal of the fabric difficult when the fabric on the panel is changed.

The prior art has thus failed to disclose a removable fabric wall panel system in which the mid-wall seams are uniform and tightly fitting, the underlying frame for the wall panels does not show through the fabric, and the fabric attachment to the panel frame does not depend entirely on glue.

SUMMARY OF THE INVENTION

The present invention satisfies the above-described needs with a fabric wall panel system and method for installing fabric wall panels on a wall. The fabric wall panels comprise a frame, a flat filler, and a fabric stretched over the flat filler and around the edges of the frame. The fabric wall panels are removably mounted on the wall by means of a hanger.

The frame of the fabric panel comprises a plurality of linear frame members. Each frame member has a flat spine, an outside web, an inside web, and a front web. Together the outside web, the inside web, and the front web form a hollow channel along the edge of the frame member. The hollow channel has an opening opposite the front web of the frame member which offers access to the inside of the hollow channel. The outside web and the inside web of the frame member each have a protrusion that extends into the channel to engage the hanger and hold the fabric wall panel in place on the wall.

The hanger comprises a flat base with two forked tongues extend perpendicularly therefrom. The base of the hanger is affixed to the wall with an adhesive or other suitable fastening means, and the forked tongues project outward from the wall. Each forked tongue has two forks that diverge from each other as they extend away from the flat base. Each fork has of cam surface and a latch surface. The material of the hanger is resilient so that the forks at their outward ends can be pressed together. The forked tongues of the hanger are aligned with and forced into the opening of the hollow channel of the frame member. The cam surfaces of the forks engage the protrusions within the hollow channel, and the forks are thereby forced together. When the frame member is fully seated onto the flat base of the hanger, the latch surfaces of the forks engage the protrusions within the hollow channel to hold the frame member securely to the hanger and thus to the wall. The fabric wall panels can be removed from the hangers by prying the frame away from the hanger to disengage the latch surfaces of the forks from the protrusions within the hollow channel of the frame members.

When the fabric is wrapped around the frame, the excess fabric is inserted into the opening of the hollow channel. Consequently, when the frame is pressed onto the hangers, the forks within the hollow channel engage the fabric and lock it between the latch surface of the fork and the protrusion within the hollow channel. Consequently, in some applications, the necessity of gluing the fabric to frame is eliminated.

The hanger of the present invention with its forked tongues assures proper spacing between the adjacent fabric wall panels mounted on the hanger. Consequently, frame members of adjacent wall panels are secured together to reduce the visibility of the seam between the adjacent wall panels and to ensure a uniform width for the seam between adjacent wall panels. In that regard, the outside web of the frame member has an angled portion near its front edge. The angled portion extends toward the adjacent wall panel thereby assuring that the adjacent panels are held tightly together in order to disguise the presence of the seam between them.

The hanger also has an index mark on the spine. The index mark is centered between the two tongues and runs the length of the hanger. The index mark serves as a guide for cutting the hanger in half along its length. Once the hanger has been cut in half along its length, the resulting half hanger has a single tongue and used for installation of the fabric wall panels adjacent a corner next to an adjoining wall.

In one embodiment of the present invention, the inside web of the frame member is shorter than the outside web of the frame member so that the front web of the frame member slopes inwardly and toward the base. Such a construction is used so that the edge between the front web and the inside web of the frame member does not show through on the front of the fabric wall panel.

In other embodiments of present invention, the front web of the frame member variously has a radius profile, a beveled profile, and a chamfered profile.

BRIEF DESCRIPTION OF THE DRAWINGS

FIG. 1 is a perspective view of a room having walls covered with a fabric wall panel system in accordance with the present invention.

FIG. 2 is a perspective view of a linear frame member and hanger in accordance with the present invention.

FIG. 5 is a cross-section view of a frame member having a front web with a radius profile.

FIG. 6 is a cross-section view of a frame member having a front web with a beveled profile.

FIG. 7 is a cross-section view of a frame member having a front web with a chamfered profile.

DETAILED DESCRIPTION OF THE PREFERRED EMBODIMENT

Figure 3:
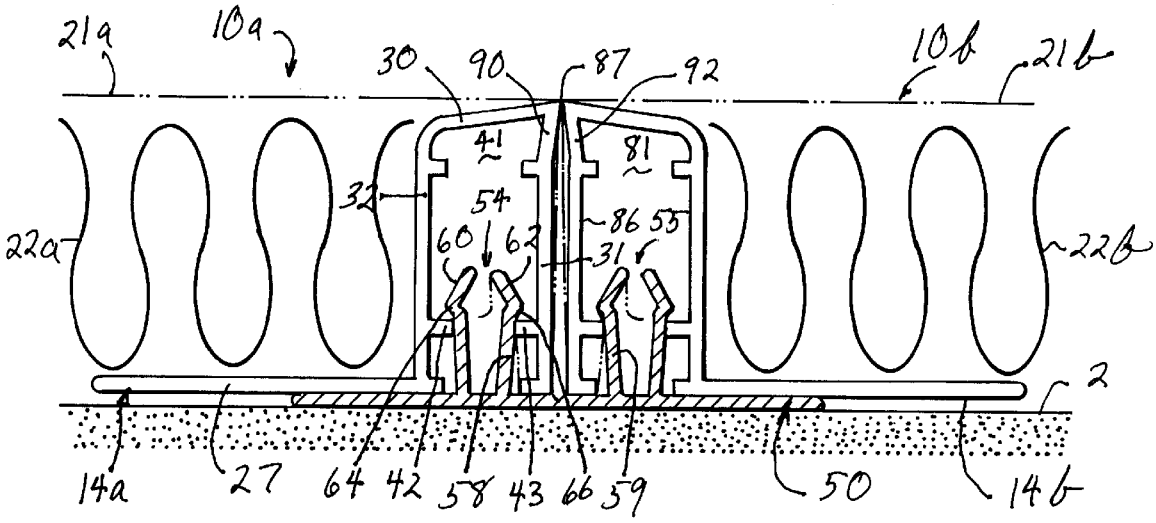
FIG. 3 is a cross-section view of a fabric wall panel mounted on a wall by means of a hanger in accordance with an embodiment of the present invention as seen along line 3—3 in FIG. 1.

The present invention is a fabric wall panel system and method for installing fabric wall panels on a wall. The fabric wall panel system comprises a fabric wall panel and a hanger. The hanger is attached to wall and releasably engages the fabric wall panel for easy installation and removal without damaging the wall. The hanger and fabric wall panels are configured so that when the fabric wall panels are mounted on the wall, the hanger assures that adjacent fabric wall panels are properly aligned and that seams between adjacent wall panels are uniform and tight.

For the purposes of the present invention, a wall includes existing or permanent walls, moveable walls, partitions, and the like. Although the present invention will be generally described in the context of a room with walls of sheet rock, those skilled in the art will recognize that the present invention is not limited to that environment. Referring now to the drawings, in which like numerals represent like elements throughout the several figures, the present invention will be described.

Turning to the figures, FIG. 1 is a perspective view of a room with a back wall 2 and a side wall 4 covered with fabric wall panels 10, including 10*a* and 10*b*, in accordance with the present invention. The room also has a ceiling 6 and a floor 7. The back wall 2 and side wall 4 converge at a corner 8. Each fabric wall panel 10 is connected to the walls 2 and 4 by means of a series of hanger hangers 50 (FIG. 2).

Each of the fabric wall panels 10 in FIG. 1 is similarly constructed. The following discussion focuses oh the two adjacent fabric wall panels 10*a* and 10*b*. Fabric wall panel 10*a* comprises a rectangular frame 12*a*, a fabric 21*a*, and a flat filler insert 22*a*. Likewise, the fabric wall panel 10*b* comprises a rectangular frame 12*b*, a fabric 21*b*, and a flat filler insert 22*b*. Each frame 12*a* and 12*b* is made up of four linear frame members 14*a*, 16*a*, 18*a*, and 20*a* and tour linear frame members 14*b*, 16*b*, 18*b*, and 20*b*, respectively. The linear frame members 14, 16, 18, and 20 are extrusions made of polyvinyl chloride (PVC). A PVC designated 7045 White 08 PVC sold by Georgia Gulf Corporation of Plaquemine, La., is useful in connection with the present invention. Metal extrusions including aluminum extrusions may also be used for the linear frame members 14, 16, 18, and 20.

Referring now to FIGS. 1 and 2, the linear frame member 14*a* is shown in perspective and comprises a flat spine 27, an inside web 32, a front web 30, and an outside web 31. The inside web 32 is connected to and extends from the spine 27. The front web 30 interconnects the inside web 32 and the outside web 31. Together the inside web 32, the front web 30, and the outside web 31 form a hollow channel 41. The hollow channel 41 has an opening 40 opposite the front web 30. A protrusion 42 extends from inside web 32 into the hollow channel 41. Likewise, a protrusion 43 extends from outside web 31 into the hollow channel 41. As will be described in greater detail, the protrusions 42 and 43 form part of a locking mechanisms that holds the fabric wall panel 10 onto the wall 2.

Figure 4:
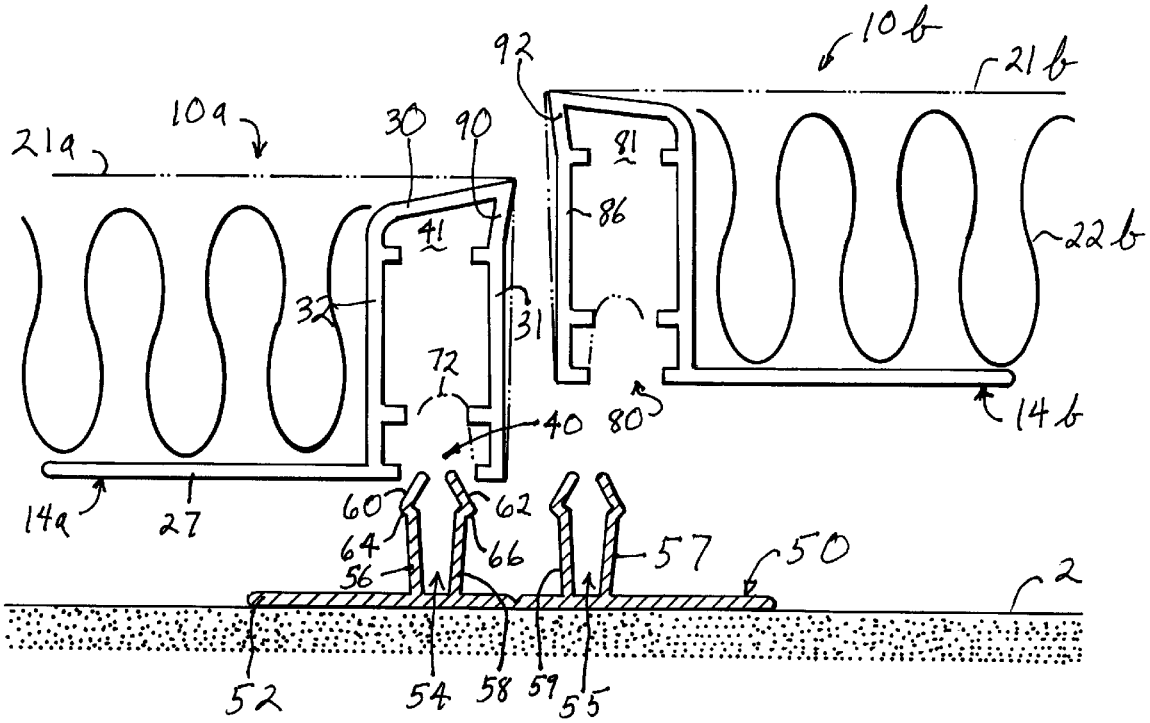
FIG. 4 is a cross-section view of a fabric wall panel, similar to FIG. 3, in the process of being mounted on a wall by means of a hanger in accordance with an embodiment of the present invention.

As shown in FIG. 2, the linear frame member 14*a* is connected to the back wall 2 by means of the hanger 50. The hanger 50 includes a base 52 which is attached to the back wall 2 by means of a suitable adhesive or by mechanical means such as cross nailing or stapling. The base 52 may be flat or slightly concave to assure that it lies flat against wall 2 once it has been installed. The hanger 50 includes forked tongues 54 and 55 (FIG. 3). As shown in FIG. 2, forked tongue 54 comprises outwardly extending forks 56 and 58. Likewise, forked tongue 55 comprises outwardly extending forks 57 and 59 (FIG. 4). The forks 56 and 58 have cam surfaces 60 and 62 and latching surfaces 64 and 66. The forks 56 and 58 are flexible so that they can deflect toward each other. The flat base 52 has an index mark 70 in the shape of a V to indicate the midpoint between the forked tongues 54 and 55. The hanger 50 is an extrusion made of polyvinyl chloride (PVC). A PVC designated 7045 White 08 PVC sold by Georgia Gulf Corporation of Plaquemine, La., is useful in connection with the present invention.

The insert 22 may consist of any number of materials to provide sound or heat insulation. The insert may be an acoustical insert in the nature of a rigid board such as Owens/Corning 705 Fiberglas insulation board sold by Owens/Corning Fiberglas Corp. of Toledo, Ohio. Alternatively, the insert may be a mineral fiber board insert such as Micore board sold by USG Acoustical Products Company of Chicago, Ill. The thickness of the insert 22, such as insert 22*a* (FIG. 3 and FIG. 4), generally equals the height of the outside web 31 so that the surface of the insert 22*b* is generally coplanar with the front web 30 of the frame member 14*a*. The insert 22, such as insert 22*a*, thus serves as a backing for the fabric 21, such as fabric 21*a*, shown in FIG. 3 and FIG. 4.

When the fabric wall panel 10*a* is prefabricated, for example, the linear frame members 14*a*, 16*a*, 18*a*, and 20*a* are miter-cut and connected at their corners in conventional fashion, such as by gluing, fasteners, or welding. The filler insert 22*a* is seated against the spine 27 of the frame 12*a*. As previously stated, the insert 22*a* not only provides sound or heat insulation, but it also provides rigidity to the frame 12*a*. The fabric wall panel 10*a* is completed by stretching fabric 21*a* over the insert 22*a* and frame 12*a*, around the front web 30 and the outside web 31, and gluing the fabric 21*a* to the back of the spine 27. SM high-strength adhesive 90 sold by 3M Company of St. Paul, Minn., has been found to be suitable for gluing a large number of fabrics to the PVC material of the frame 12*a*. The fabric 21*a* may be attached in any other suitable fashion such as by stapling. Any excess fabric 72 (FIGS. 1 and 4) may be inserted into the hollow channel 41 through opening 40. As will be explained in greater detail below, the excess fabric 72 is locked within the hollow channel 41 thereby assuring a taut fit. Once the fabric wall panel 10*a* has been prefabricated, it is attached to the wall using hangers 50.

With reference to FIGS. 3 and 4, the installation of the wall panels 10*a* and 10*b* onto the back wall 2 is illustrated. The hanger 50, which is one of a several hangers, is mounted to the back wall 2 by means of gluing, cross nailing, or stapling. A separate contact adhesive on the back of the hanger 50 may be used to secure the hanger 50 to the back wall 2 until the separately applied adhesive has fully cured.

With continuing reference to FIGS. 3 and 4, each hanger 50 is positioned on the wall so that the forked tongue 54 aligns with the opening 40 of hollow channel 41 for frame member 14*a* of fabric panel 10*a*. Similarly, the forked tongue 55 aligns with opening 80 of hollow channel 81 for frame member 14*b* of fabric panel 10*b*. Because the forked tongues 54 and 55 are mounted to a single hanger base 52, their spacing is fixed. Once the openings 40 and 80 of the fabric panels 10*a* and 10*b* are aligned with the forked tongues 54 and 55, the fabric panels 10*a* and 10*b* are moved toward the wall 2. As the forked tongue 54 enters into the opening 40 of the frame member 14*a*, the cam surfaces 60 and 62 engage the protrusions 42 and 43 inside the hollow channel 41. As result of the engagement of the cam surfaces 60 and 62 and protrusions 42 and 43, the forks 56 and 58 are forced toward each other. As the frame member 14*a* is moved toward the base 52 of the hanger 50, the cam surfaces 60 and 62 pass by the protrusions 42 and 43 so that forks 56 and 58 spring back and the latching surfaces 64 and 66 engage the protrusions 42 and 43 as shown in FIG. 3. With the frame member 14*a* seated against the base 52 of the hanger 50, the latching surfaces 64 and 66 engage the protrusions 42 and 43 to hold the frame member 14*b* in place.

Once both fabric wall panels 10*a* and 10*b* are seated at shown in FIG. 3, the forks 58 and 59 adjacent the marker index 70 urge to the fabric wall panels 10*a* and 10*b* toward each other so that any spacing, at seam 87 between the fabric panels 10*a* and 10*b*, is minimized. In addition, the outside webs 31 and 86 (FIG. 3) have portions 90 and 92 which angle outwardly from the plane of the outside webs 31 and 86. The outward angle portions 90 and 92 further assure that seam 87 remains closed. The flexibility of the forks 58 and 59 allow the fabric wall panel system to accommodate fabrics of different thickness and still assure that the seam 87 remains closed.

The flexible forks 58 and 59 of the flexible tongues 54 and 55 also serve to capture the excess fabric 72 at the point where, for example, the latching surface 66 engaged protrusion 43. The engagement of the excess fabric 72 at protrusion 43 assured that the fabric is additionally stretched as the tongues 54 and 55 enter the hollow channels 41 and 81.

The index mark 70 on the hanger 50 indicates a point at which the hanger can be cut into two parts when installation next to a corner, such as corner 8, is required. Again, the flexible forks 58 urges the fabric panel 10*a* toward the index mark 70 and thus toward and adjacent wall.

When the fabric panels 10 need replacement, the process is reversed and each fabric panel is pulled off of the underlying hanger 50. The exertion of the outward force on the fabric panels 10 causes the latching surfaces, e.g. 64 and 66 (FIG. 4) to disengage the protrusions 42 and 43 thereby releasing the panel can be from the wall 2. Once the new fabric has been stretched around the frame 12 of the fabric panel 10, the hanging process is repeated using the same hangers that were previously installed. Particularly, the system allows for the replacement of a thin fabric with a thick fabric and vice versa because of the flexible forks 58 and 59 urge the fabric panels 10*a* and 10*b* together at seam 87.

With respect to the profile of the frame member 14*a*, the front web 30 slopes toward the spine 27 from the outside web 31 toward the inside web 32. For that particular profile, the slope of wall 30 assures that the front surface of the insert 22*a* does not contact fabric 21*a* and therefore show through on the front of the fabric panel 10*b*.

FIG. 5, FIG. 6, and FIG. 7 disclose additional profiles for the frame members. Particularly, FIG. 5 shows a radius profile 100 for the frame member 14*b*. FIG. 6 shows a beveled profile 102 for the frame member 14*b*. FIG. 7 shows a chamfered profile 104 for the frame member 14*b*. In each of the alternative profiles, the flexible forks serve the same function to a sure that the seams at 105, 106, and 107 remained substantially closed and can accommodate fabrics of different thickness.

On-site customization of fabric wall panels 10 is a simple process. The linear frame members 14, 16, 18, and 20 are first cut to the exact size of the space required, and the ends are mitered to accommodate the exact angles of the wall space. Once cut and mitered, the linear frame members 14, 16, 18, and 20 are then temporarily attached to the wall to assure accuracy of the cuts. The flat filler insert 22 is then cut according to the measurements of the temporarily attached frame members 14, 16, 18, and 20 so that the insert 22 fits within the frame 12. The fabric 21 is attached by stretching it over the frame 12 and gluing it to the back of the spine 27 of the linear frame members 14, 16, 18, and 20 and inserting the excess fabric 72 into the hollow channels of the frame members. With the fabric 21 attached, the fabric wall panel 10 is reinstalled on the wall using hangers 50, as previously described.

Once fabric wall panels 10 have been installed according to the above-described system, removal and replacement of the fabric wall panels 10 is a simpler process. Any fabric wall panel 10 can be independently removed by unsnapping the fabric wall panel 10 from the supporting hangers 35. Another panel may be installed in the other panel's place by simply snapping the new panel onto the existing hangers. If one desires to remove the panels entirely, all of the panels can be removed by unsnapping each panel from the supporting hanger and removing the hangers from the wall.

In summary, the present invention provides an improved and simplified fabric wall panel system for installing fabric wall panels employing a snap hanger. By utilizing the disclosed method for installing fabric wall panels, the removal and replacement process is less complicated. Therefore, the preferred embodiment of the present invention allows for easy installation and removal of fabric wall panels, whereby the procedure does not damage the wall.

Alternative embodiments will become apparent to those skilled in the art to which the present invention pertains without departing from its spirit and scope. Accordingly, the scope of the present invention is defined by the appended claims rather than the foregoing description.

I claim:

1. A fabric wall panel system for a wall comprising:

a. a fabric wall panel comprising:

i. a frame comprising a plurality of frame members connected together to form the frame, each frame member comprising:

(a) a flat spine;

(b) a front web;

(c) an outside web; and (d) an inside web, wherein the front web, the outside web, and the inside web form a channel with an opening opposite the front web and wherein the outside web and the inside web each have a protrusion extending into the channel; and ii. a fabric stretched over and around the frame; and b. a hanger comprising:

i. a flat or slightly concave base attached to and lying flat against the wall; and ii. an elongated tongue comprising two flexible forks each extending from the base and for insertion into the opening and each flexible fork comprising:

(a) a camming surface for engaging at least one of the protrusions to deflect the forks toward each other during insertion; and (b) a latching surface to engage at least one of the protrusions to hold the frame to the hanger, wherein the forks, the outside web of the frame member, and the inside web of the frame member are dimensioned so that the flat spine of the frame member seats directly against the base of the hanger.

2. The fabric wall panel system of claim 1, wherein the base of the hanger has two flexible tongues positioned side by side to engage two frame members, and the flexible forks, when inserted in the channels of the frame members, urge the fabric wall panels together.

3. The fabric wall panel system of claim 2, wherein the base of the hanger has an index mark between the tongues to mark a cut line for providing a single tongue hanger for use in a corner installation.

4. The fabric wall panel system of claim 1, wherein portions of the fabric that extend around the frame and adjacent the opening are inserted into the opening and engage at least one of the protrusions and the latching surface, and the remaining fabric is contained within the channel.

5. The fabric wall panel system of claim 1, wherein the outside web is longer that the inside web so that the front web of the frame member is slopes toward the base.

6. The fabric wall panel system of claim 1, wherein the outside web is angles outwardly near its intersection with the front web.

7. The fabric wall panel system of claim 1, wherein the front web has a radius profile.

8. The fabric wall panel system of claim 1, wherein the front web has a beveled profile.

9. The fabric wall panel system of claim 1, wherein the front web has a chamfered profile.

10. A method for installing a fabric wall panel on a wall, comprising the steps of:

a. assembling a fabric wall panel by:

i. assembling a frame comprising a plurality of frame members connected together to form the frame, each frame member comprising:

(a) a flat spine;

(b) a front web;

(c) an outside web; and (d) an inside web, wherein the front web, the outside web, and the inside web form a channel with an opening opposite the front web and wherein the outside web and the inside web each have a protrusion extending into the channel; and ii. stretching a fabric stretched over and around the frame and inserting any remaining portions of fabric that extend around the frame into the opening;

b. affixing a plurality of hangers to the wall in an aligning relationship to the elongated slits in the spines of the frame members, each hanger comprising:

i. a base; and ii. an elongated tongue comprising two flexible forks each extending from the base and for insertion into the opening and each flexible fork comprising:

(a) a camming surface for engaging at least one of the protrusions to deflect the forks toward each other during insertion; and (b) a latching surface to engage at least one of the protrusions to hold the frame to the hanger.

c. engaging the tongue of the hanger with the aligned openings of the frame members and pressing the fabric wall panel so that the elongated tongues are inserted in the opening and the latching surface engages the portrusion, wherein the forks, the outside web of the frame member, and the inside web of the frame member are dimensioned so that the flat spine of the frame member seats directly against the base of the hanger.

11. The method of claim 10, wherein the method further comprises the step of removing the fabric wall panel by pulling the wall panel so that the latching surface disengages the protrusion and releases the wall panel from the hanger.

12. The method of claim 10, wherein the base of the hanger has two flexible tongues positioned side by side to engage two frame members, and the flexible forks, when inserted in the channels of the frame members, urge the fabric wall panels together.

13. The method of claim 12, wherein the base of the hanger has an index mark between the tongues to mark a cut line for providing a single tongue hanger for use in a corner installation.

14. The method of claim 10, wherein portions of the fabric that extend around the frame and adjacent the opening are inserted into the opening and engage at least one of the protrusions and the latching surface, and the remaining fabric is contained within the channel.

15. The method of claim 10, wherein the outside web is longer that the inside web so that the front web of the frame member is slopes toward the base.

16. The method of claim 10, wherein the outside web is angles outwardly near its intersection with the front web.

17. The method of claim 10, wherein the front web has a radius profile.

18. The method of claim 10, wherein the front web has a beveled profile.

19. The method of claim 10, wherein the front web has a chamfered profile.

* * * * *